US008664839B2

(12) United States Patent
Zimmerman

(10) Patent No.: US 8,664,839 B2
(45) Date of Patent: Mar. 4, 2014

(54) ELECTRODE COVER ASSEMBLY

(76) Inventor: Eric K Zimmerman, Huntington Park, CA (US)

( * ) Notice: Subject to any disclaimer, the term of this patent is extended or adjusted under 35 U.S.C. 154(b) by 39 days.

(21) Appl. No.: 13/564,709

(22) Filed: Aug. 1, 2012

(65) Prior Publication Data

US 2012/0293059 A1 Nov. 22, 2012

Related U.S. Application Data

(63) Continuation of application No. 13/275,275, filed on Oct. 17, 2011, now Pat. No. 8,258,684.

(60) Provisional application No. 61/394,346, filed on Oct. 18, 2010.

(51) Int. Cl.
*H01J 5/48* (2006.01)

(52) U.S. Cl.
USPC ..... 313/49; 313/51; 313/567

(58) Field of Classification Search
USPC ..... 313/49, 51, 567
See application file for complete search history.

(56) References Cited

U.S. PATENT DOCUMENTS

| | | | | | |
|---|---|---|---|---|---|
| 6,135,620 | A * | 10/2000 | Marsh | ..... | 362/377 |
| 2003/0179577 | A1 * | 9/2003 | Marsh | ..... | 362/260 |
| 2006/0284560 | A1 * | 12/2006 | Park et al. | ..... | 313/634 |

* cited by examiner

*Primary Examiner* — Mary Ellen Bowman
(74) *Attorney, Agent, or Firm* — Khoo Patent Services

(57) ABSTRACT

A cold cathode lighting system comprising a cold cathode lamp with electrodes on either end of the lamp, oriented such that it includes an electrode extension in order to return the electrode to the same parallel position as the main body of the lamp. The lamp's electrodes are inserted into a casing that is comprised of a casing covers on either ends of the casing which may slid be opened. The casing covers interact with a electrode cover assembly underneath the casing covers, that allows the lamp to be inserted when the casing covers are opened. The closing of the casing covers will safely engage an interconnection with the lamp's electrodes through the electrode cover assembly.

15 Claims, 19 Drawing Sheets

ELECTRODE COVER ASSEMBLY

This patent application is a continuation of U.S. Non-Provisional patent application Ser. No. 13/275,275 by Eric K. Zimmerman filed on Oct. 17, 2011 now U.S. Pat. No. 8,258,684. This patent application claims the benefit of, priority of, and incorporates by reference U.S. Non-Provisional patent application Ser. No. 13/275,275 by Eric K. Zimmerman filed on Oct. 17, 2011, which in turns claims the benefit of U.S. Provisional Patent Application Ser. No. 61/394,346, entitled "Cold Cathode Light Fixture" by Eric K. Zimmerman filed on Oct. 18, 2010.

BACKGROUND OF THE INVENTION

1. Field of the Invention

The present invention relates to a lighting system and more particularly, a cold cathode lighting system.

2. Description of the Related Art

Cold cathode lighting is commonly used as an indirect light source that provides a very appealing glow that evenly wash adjacent surfaces & or objects such as walls, ceiling, book cases, furniture, etc. It is used for many different interior and exterior architectural applications. It is used as hidden light source in coves accentuate corner transition between walls and ceilings. In any application it can be used as decorative, supplemental and or functional lighting.

Other light sources that are used in cove lighting systems include in part hot cathode fluorescent lamps, incandescent lamps, PL lamps and LED. The following lists why these lamp configurations have many disadvantages.

Hot cathode fluorescent lamps are only sold in standard straight sizes and not easily made to conform to curves in a cove. They come in limited colors and are not easily made to be dimmable. The lamps cannot be illuminated end to end. They have a relatively short life span.

Incandescent lamps are not energy efficient. Their lifespan is short and need replacement often. A row of bulbs does not produce smooth continuous glow of illumination.

PL lamps also produce uneven illumination. They cannot be dimmed easily and come in only a few colors. They have short life spans.

LED standard output systems for coves have very low light out levels and have a very limited choice of colors.

Cold cathode lighting has many advantages by comparison. Cold cathode lighting has a much longer life span then other light sources. Each lamp illuminates from end to end with no socket interruption and positioned with a small fraction of space between each lamp end resulting continuous shadow free illumination. The lamps can be easily made curved to fit any shape cove and are dimmable. They come in a multitude of colors. There are additional advantages when using low voltage cold cathode lighting systems in that individual fixtures can be produced to achieve the same advantages as mentioned above.

Cold cathode lamps are commonly constructed from 3 tubular glass sections that are fused together. The first tubular glass section is the main body which produces end-to-end illumination. The main body can be produced in almost any specified length that are straight or formed to match the contours of the lamps mounting surfaces such as curved and angular building surfaces. Cold cathode lamps bodies have a maximum length of 8' and cross sectional diameter ranging from 18 mm to 25 mm. The second tubular glass section is a pair of electrodes, each of which are located on both of the furthermost ends of the lamp body. The third tubular glass section is fused between the electrode and main body as means to extend the distance and orientation of the electrode in relation to the main body as required. Various orientations of the electrodes are required to accommodate the range of configurations including right angles, bend backs, double right angles, etc., that are dictated by different devices including prior art. These devices have been developed to insulate, cover, support, interconnect and/or other related requirements to assist in protecting the electrode from being damaged and/or causing any electrical safety hazards. The electrode is the means for transferring electricity from an external power source through the interior of the lamp between the electrodes to produce the necessary power to excite and illuminate gases such as argon mercury vapor. The construction of each electrode includes leads that are hermetically sealed so that they can extend from the interior of the lamp to its exterior through tip of the electrode. There are various means to safely and securely assist in the continuity between the connection of the electrode leads and electrical wire that originate from the required power source. Depending upon the type of said power source they can be located remotely at varying distances such as 10', 20', 30' or more with the intent that the power sources must still be positioned as close to the cold cathode lamps as possible.

Other types of power sources are located in close proximity of the cold cathode lamps in various types of metal casings that commonly support the main body of the cold cathode lamp mention above. There is an industry standard designation between these two types of power sources used for cold cathode lamps, based on output voltage. The two designations are a) high voltage over 1000 volts such as a high voltage magnetic transformer each of which commonly operate as many as 10 lamps and b) low voltage power source under 1000 volts such as an electronic power supply sometimes referred as a ballast each of which commonly operates one lamp.

Advantages for using low voltage cathode lighting is that it is much safer and therefore complies to the NEC for use in residential applications, whereas high voltage systems are not allowed. Low voltage cathode lighting provides the ability to produce individual fixtures that include one or more casings that support the cold cathode lamp. These fixtures can be prefabricated, eliminating the need to ship separate components to be installed in the field, which is one of the disadvantages for high voltage cold cathode lighting systems. Each low voltage cathode light fixture includes one or more power supply to energize one cathode lamp. There is one cold cathode lamp per fixture. Low voltage cold cathode lighting has a much longer life span then other light sources. The lamps evenly illuminate from end-to-end with no socket interruption. Therefore each lamp can be positioned with a small fraction space between each lamp end, resulting in even, shadow-free illumination. The lamps can be easily curved to fit any cove shape and are dimmable.

There are various devices used to insulate, cover, support, interconnect and/or other related requirements to assist in protecting the cold cathode lamp electrodes from being damaged and/or causing any electrical safety hazards. However what all of these devices have in common is that they all fall short in avoiding damage or breakage of the electrodes as intended. The components of these devices have not been produced to be foolproof from damaging the electrode, tubular extension &/or main lamp body. Such damage can be caused by twisting, applying tension or compression resulting in direct fractures, or tiny hairline cracks, [generally during installation?]. All of which will cause the lamps to become inoperable. The cathode lamp components that have these drawbacks are cold electrode receptacles commonly called lamp holders, polymeric insulator boots, glass insulator cups, double right angle electrode lamp base, amongst others. These drawbacks are described below.

Disadvantages to the right angle orientation are that the lamp is pushed into an electrode receptacle or lamp holder, forcing it until it makes positive contact between the ferrule or button shaped electrode. The lamp can break and cause injury. The lamp also extends out of the lampholder high into the cove requiring a higher cove lip to hide the lamp.

A bend back orientation is where the electrode extension is bent and returns the electrode to the same parallel position as the main glass lamp. A glass cup can be used in place of the polymeric boot, but is large and bulky and requires a clip to keep it from slipping off and is extremely difficult to attach to a mounting surface so that it is positioned correctly.

Glass insulator cups have to manually twist the wire from the power source to the electrode leads and then manually cover that connection with a polymeric boot for insulation with a risk of breakage from the resistance when force is applied.

The disadvantage to a double right angle bend back that uses a bridge support between the main body of lamp and electrode is that physical force has to be applied with the hand to mount it to a contact located at the end of a metal mounting enclosure.

BRIEF SUMMARY OF THE INVENTION

In an embodiment of the invention, a lighting system is disclosed, with a unique method of connecting a cold cathode lamp to electrode covers that properly insulate and securely interconnects the electrical wire from the power source to the lamp electrode in a manner that eliminates any pressure, torque, stress that could damage or break the electrodes.

In this embodiment, a low voltage cold cathode lamp is utilized. This lamp has electrodes on either end of the lamp oriented such that it includes an electrode extension in order to return the electrode to the same parallel position as the main body of the lamp. This electrode configuration is practical and simple to produce for those familiar with producing cold cathode lamps compared to other electrode configurations.

This lighting system has two sliding access doors (called casing cover end segments) with U shaped notches on the outboard edges. They may be slid into the open position to allow for the insertion of the lamp's electrodes, at both ends. The sliding access doors slide in a linear motion and to a controlled position. This controlled position is to accommodate precise alignment and spacing for the lamp electrode tip to be seated and engaged properly.

An electrode cover assembly is located in the interior of the casing below the sliding access door. This assembly includes a base that supports the electrode cover and interfaces with a track in order to properly slide back the electrode cover in a linear motion to the exact position required. The electrode cover consists of a ceramic insulator in the shape of a cylinder that is open on one end to allow the entry of the lamp's electrode. The electrode cover includes an internal electrical contact spring that interconnects with a metal cap that is located at the tip of the lamp's electrode. The base that supports the electrode cover is attached to a spring or alternate tensioning device. The base automatically retracts the electrode cover to its proper position for insertion of the electrode when the sliding door is moved to the open position. The base support of the electrode cover slides along a rail or track as the sliding door is opened in order to maintain the correct alignment when the electrodes are positioned in the interconnect location below the sliding door.

After the lamps electrodes are in position, the base of the electrode covers automatically slide towards the electrode as the sliding doors are being closed. The electrode cover gently engages the electrode and the electrode contact interconnects with the electrode cap. Thereafter, the lamp is ready for operation.

The positioning and engaging of the electrode cover with the lamp's electrode is accomplished without applying any force pressure, torque, or stress that could damage or break the cold cathode lamp and/or the electrodes, both of which would cause the lamp to be inoperable. Further, during the process of positioning the cold cathode lamp and electrodes there is no requirement to physically handle or manipulate any components necessary for interconnecting power to the said electrodes. This is also advantageous for the reverse operation and removal of the lamps and electrodes.

In an alternate assembly, a small portion of the top cover, known as the detachable casing cover segment, is disengaged from the lower housing and removed from the casing at opposing ends of the system. This open space now allows the end access covers (or casing cover end segments) with the attached electrode cover assemblies to be slid into said vacated space. The electrode cover assemblies can now interface with the lamp electrodes as above and slide within integral tracks located on the underside of the above mentioned end covers.

BRIEF DESCRIPTION OF THE DRAWINGS

A more complete appreciation of the invention and many of the advantages thereof will be readily obtained as the same becomes better understood by reference to the detailed description when considered in connection with the accompanying drawings, wherein.

DETAILED DESCRIPTION

Figure 1:
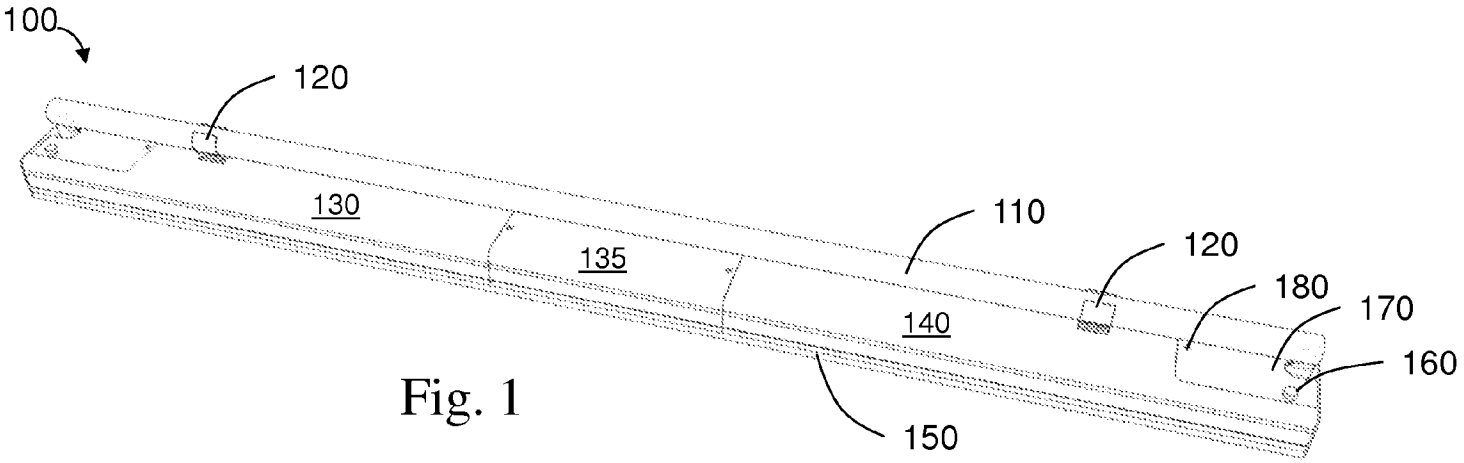
FIG. 1 is a perspective view showing an embodiment of a hybrid lighting system.
Figure 2:
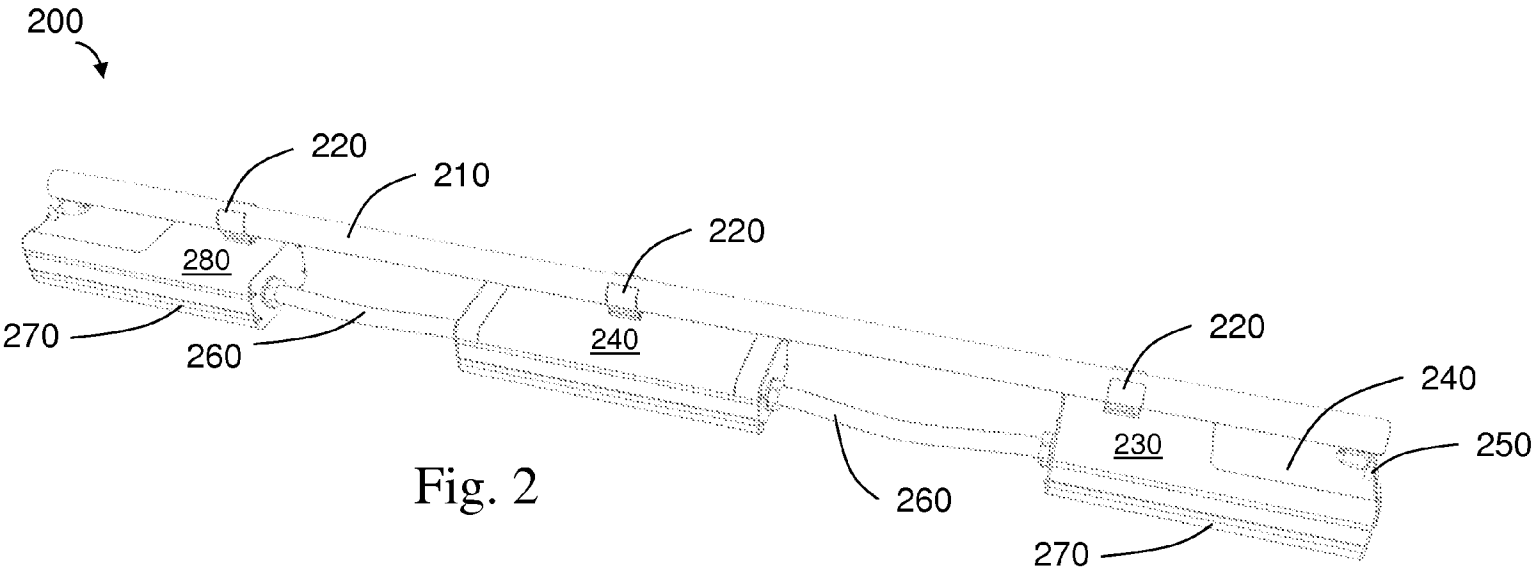
FIG. 2 is a perspective view showing an embodiment of a hybrid flexible lighting system.
Figure 6:
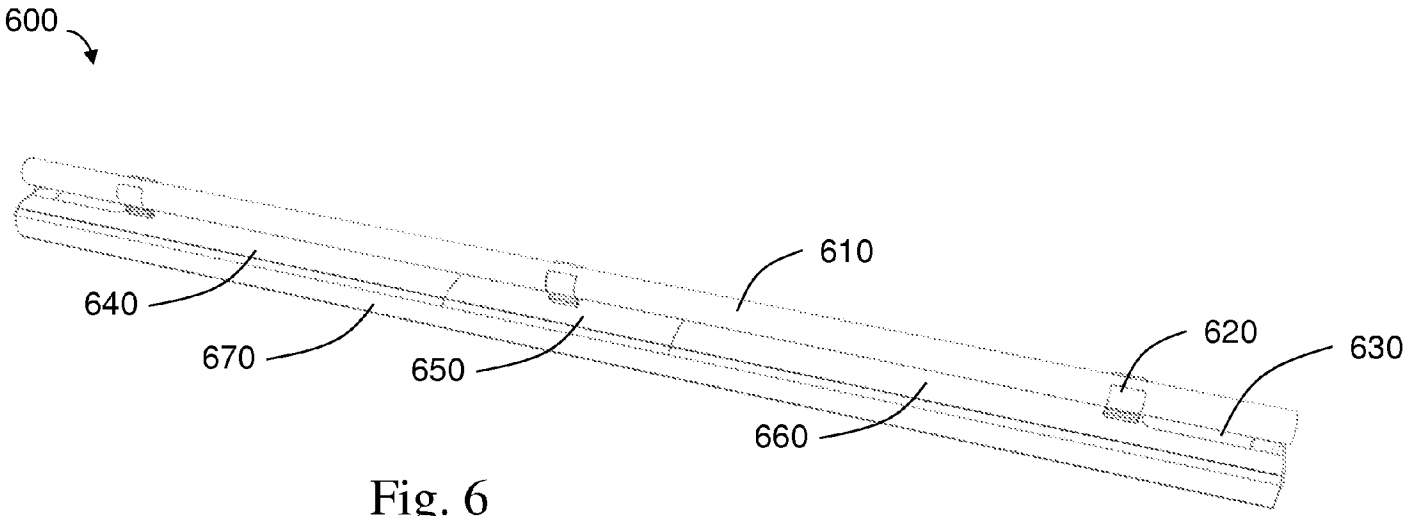
FIG. 6 is a perspective view showing an embodiment of a mini lighting system.
Figure 7:
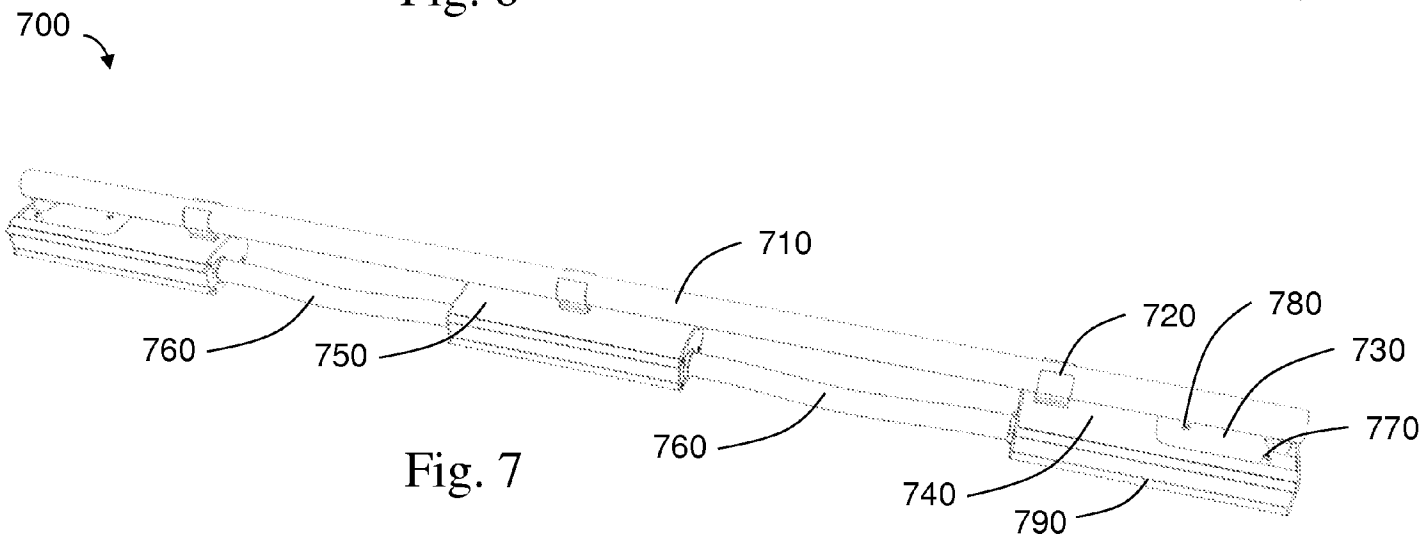
FIG. 7 is a perspective view showing an embodiment of a flexible mini lighting system.

FIG. 1 shows an embodiment of a lighting system. This light fixture is considered a hybrid lighting system and is of a standard size. FIG. 2 is another embodiment demonstrating a flexible version of the hybrid lighting system 100. This is called the hybrid flexible lighting system. FIG. 6 and FIG. 7 are further embodiments that show mini versions of hybrid lighting system 100 and hybrid flexible lighting system 200. FIG. 6 is called a mini lighting system and FIG. 7 is called a mini flexible lighting system. The various lighting system 100 200 600 700 demonstrate different lighting system styles with varying degrees of variation, but also have some general commonalities. For example, the casing of the lighting system is generally comprised of a lower box and upper box. In FIG. 1, the upper boxes are 130 and 140, with a lower box of 150. In FIG. 2, the upper boxes are 230 and 280, with a lower box of 270.

The flexible lighting system 200 700 have flexible raceway hoses 260 760 and is comprised of multiple casings. The casings may be arranged to allow for other than a straight-line lamp to accommodate the specific requirements for architectural conditions in which they are being used.

In these embodiments, the power supply generally sits in the middle of the lighting system, and is covered by a power supply access panel. This power supply access panel can be seen in 135 in FIG. 1 and in 240 in FIG. 2. Lamp clips 120 220 hold the lamp in place.

Figure 3:
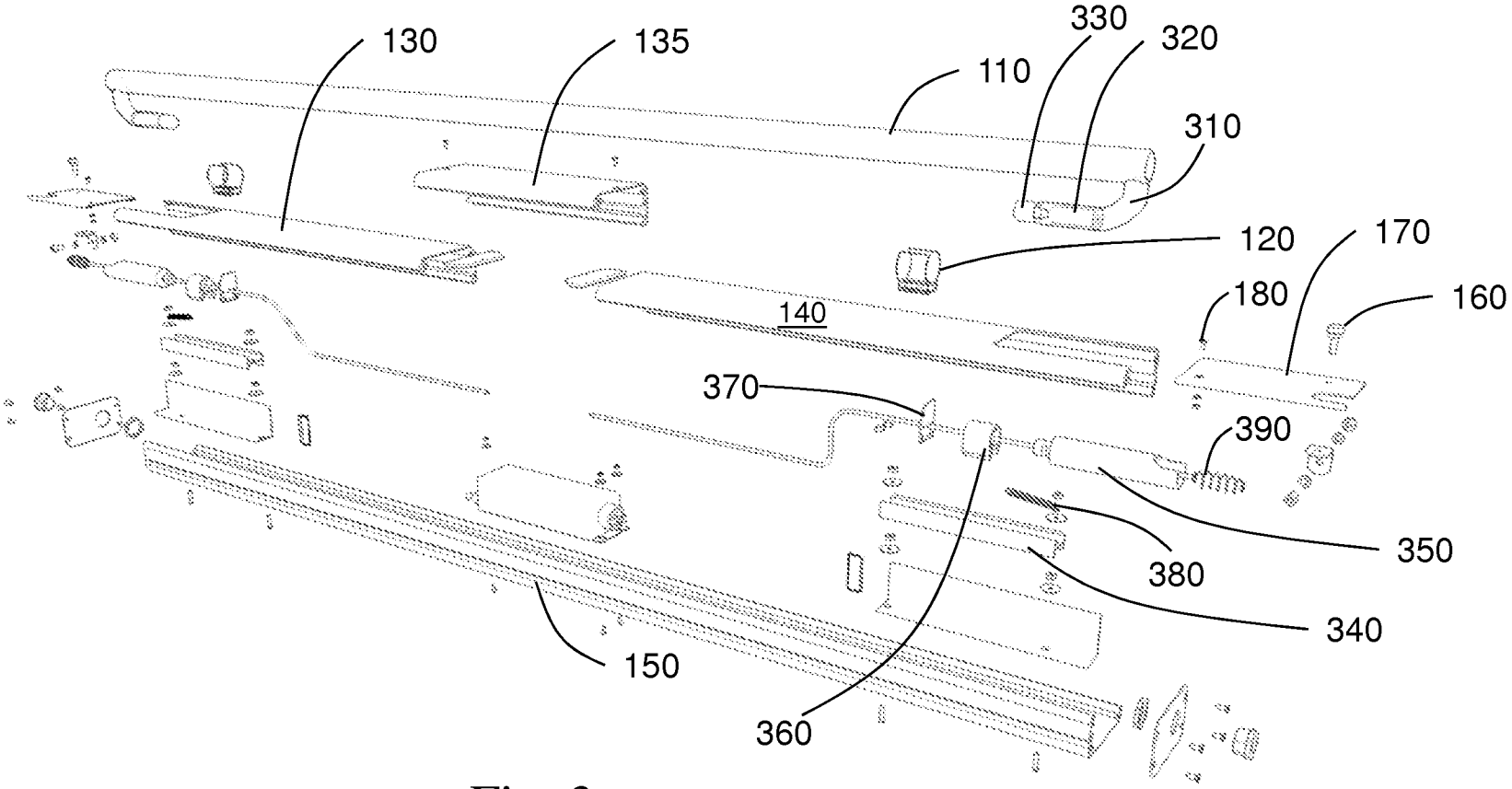
FIG. 3 is an exploded view of the hybrid lighting system for FIG. 1.

FIG. 3 shows an exploded view of the hybrid lighting system 100. This exploded view reveals the internal components and provides a better perspective of the functional components.

The lighting system in all of the present embodiments accommodate a cathode lamp 110 with its electrodes 320 connected through a bend back 310 on both ends. The electrodes 320 are terminated with an electrode cap 330. A casing cover end segment 170 240 may be slid open so that the electrode 320 may be inserted into the lighting system. The sliding casing cover end segment has a thumb/pull screw 160 250, that may be used to fasten the segment in the closed position, and may also serve as a knob in order to slide the segment manually open. The upper box 140 230 incorporates two opposing horizontal tracks for the casing cover end segment 170 240 to slide along.

Figure 4:
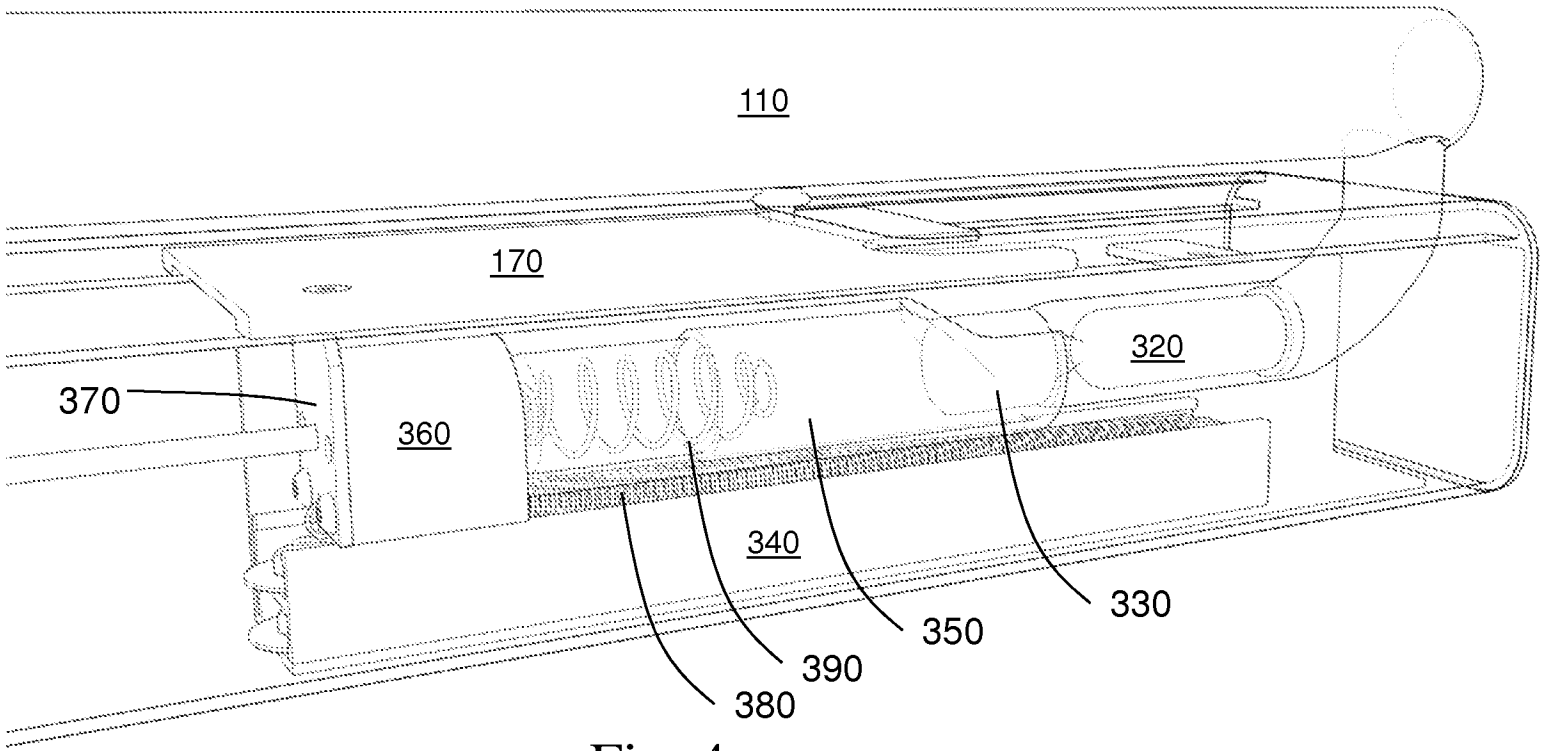
FIG. 4 is a partial view of the hybrid lighting system of FIG. 1 with a casing cover end segment slid open.

There is a track 340 attached to the lower box 150 that provides a linear path for the U Chamber 360 to move along. The electrode cover 350 has one end fitted within the U chamber 360. There is a U chamber end plate 370 that extends beyond the upper (top) portion of the U chamber 360, such that it is in the path of the push back screw 180 attached to the casing cover end segment 170. The U chamber end plate 370 and U chamber 360 are known as electrode cover adapters, since they attach to the electrode cover for various functional purposes. As the casing cover end segment 170 slides into the open position, the push back screw 180 travels towards the U chamber end plate 370. As the casing cover end segment 170 continues sliding open, the push back screw 180 will come in contact with the U chamber end plate 370, pushes the U chamber end plate 370. This force causes the attached U chamber 360 and electrode cover 350 to slide inward along the track 340, putting the U chamber 360 and electrode cover 350 in their retracted position. While in this retracted position, the cold cathode lamp 110 with the lamp electrode 320 facing down towards the lamp light system can be inserted through the opening left by the retracted casing cover end segment 170. FIG. 4 shows a cold cathode lamp 110 with its electrode 320 inserted through the opening. The electrode 320 and/or electrode cap 330 make contact with the retracted electrode cover 350 putting the cold cathode lamp 110 into proper alignment for the casing cover end segment 170, electrode cover 350 and U chamber 360 assembly to be returned to a closed positioned. The track spring 380 is stretched when the casing cover end segment 170 is in its open position, and the track spring's 380 retraction force causes the U chamber 360 and its attached U chamber end plate 370 to move in the outward direction, thus closing the casing cover end segment 170 through the push back screw 180. The track spring 380 also allows for the electrode cover 350 to push towards the electrode cap 330 of the lamp 110 to make contact. Also, track spring 380 allows for the electrode cover 350 to stop at varying retracted positions to accommodate varying locations of the lamp's 110 electrode cap 330. This important aspect prevents the electrode cover 350 and/or spring contact 390 from applying too much pressure against the electrode cap 330 of the lamp 110. Also, the electrode cover 350 and electrode cover adapter 360 are loosely held by the track, thus allowing the electrode cover to have some play or wiggle room. This wiggle room is important in accommodating variations in the angle of the electrode protrusion of the lamp.

Figure 5:
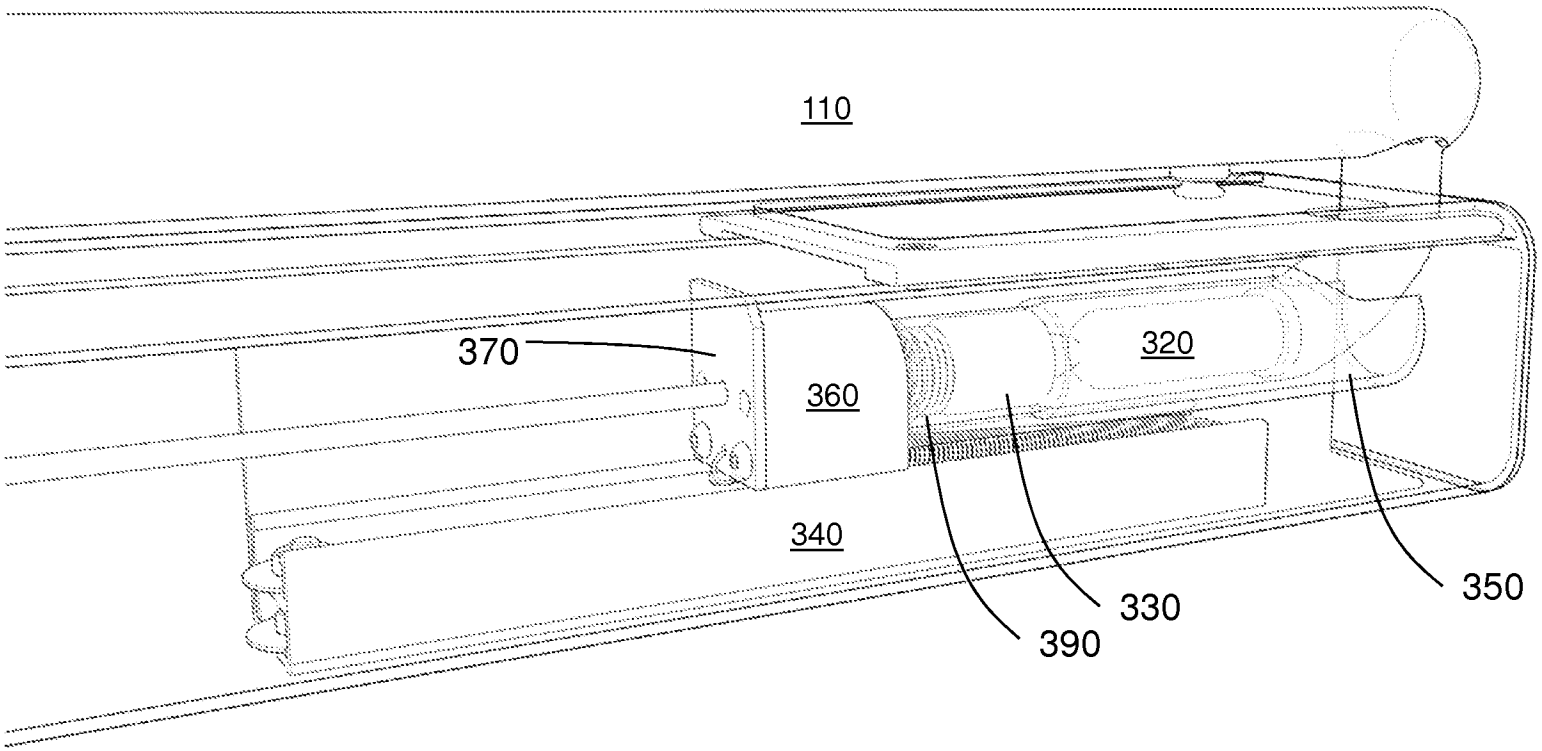
FIG. 5 is a partial view of the hybrid lighting system of FIG. 1 with a casing cover end segment slid closed.

FIG. 5 displays the lighting system in its closed position. When in this closed position, the spring contact 390 makes an electrical contact with the lamp electrode cap 330. After engaging both electrodes 320 of the lamp 110, the electrical circuit is complete, allowing the lamp to be energized.

As discussed earlier, FIG. 6 and FIG. 7 display mini versions of the lighting system. The general principles discussed above, of having a casing cover end segment with an internal assembly for the insertion of a cold cathode lamp, applies for these embodiments. There are slight differences in these embodiments to accommodate the smaller size of these fixtures.

Figure 8:
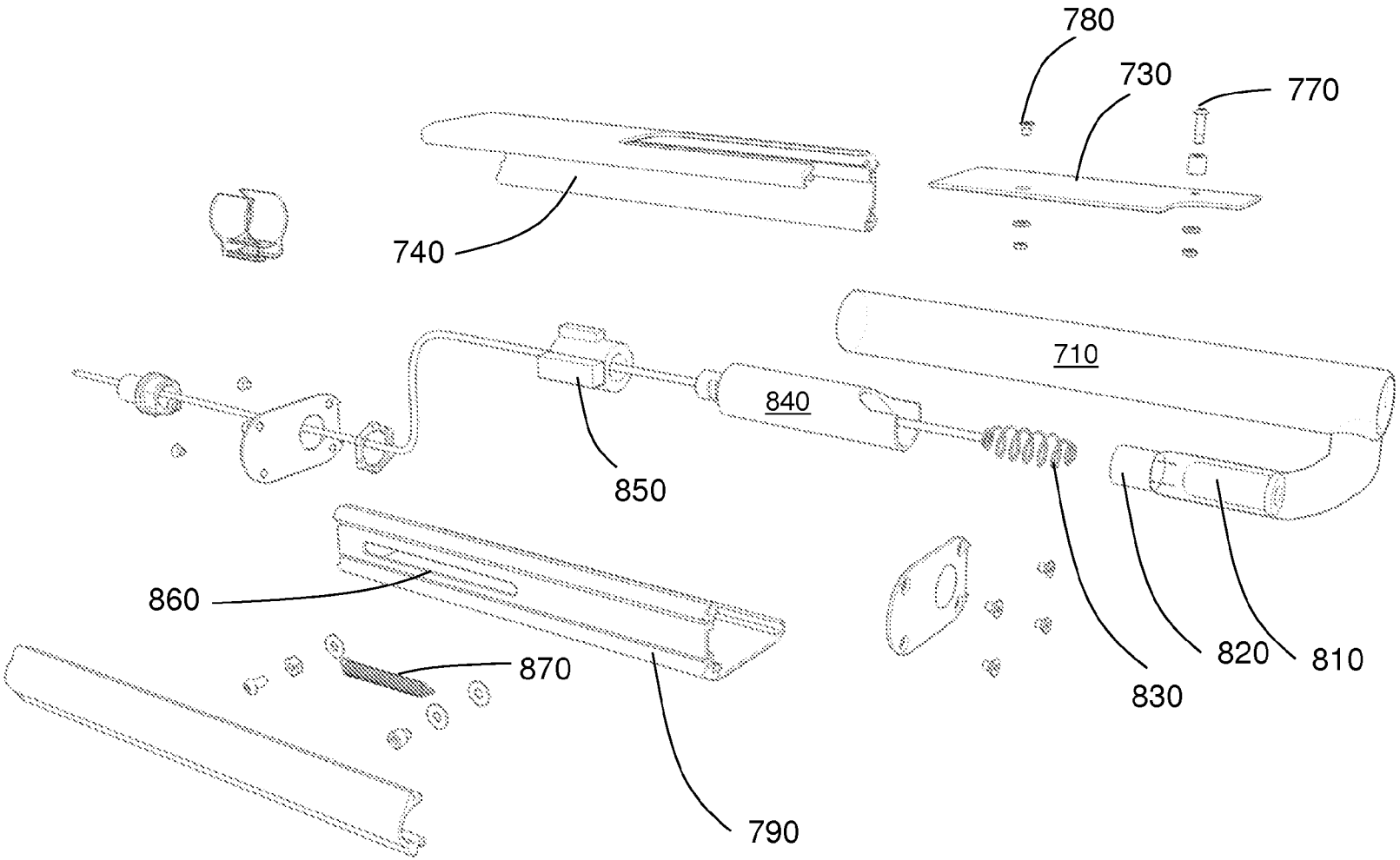
FIG. 8 is an exploded view of one end of the mini lighting system of FIG. 6.

An exploded view of an end of the mini flexible fixture 700 end is shown in FIG. 8. The casing cover end segment 730 slides on the horizontal tracks within the upper box 740. The casing cover end segment 730 has a thumb/pull screw 770 used to fasten the door in the closed position and to use as a knob for manually sliding the casing cover end segment 730. The lower box 790 has an incorporated track in its sidewall, and provides a linear path for the sliding electrode cover mount 850 to move along. In this embodiment, the electrode cover mount 850 is considered an electrode cover adapter, since it attaches to the electrode cover to provide various functional purposes. The sliding electrode cover mount 850 is shaped such that it is in the path of the push back screw 780. As the casing cover end segment 730 is slid into the open position, the push back screw 780 travels towards the sliding electrode cover mount 850 and will eventually make contact with the sliding electrode cover mount 850. As the casing cover end segment 730 continues moving towards the open position, the necessary force is applied by the push back screw 780 against the sliding electrode cover mount 850 to cause the sliding electrode cover mount 850 to slide inward along the track incorporated in the lower box 790. An electrode cover 840 fitted to the sliding electrode cover mount 850 moves inward as well, and will now be in the retracted position. The sliding electrode cover mount 850 is loosely secured to the sidewall of the lower box 790 with a screw projecting through a linear slot track 860. This attachment allows the sliding electrode cover mount 850 assembly to slide back and forth along the track 860. The screw is also the attachment point for the track spring 870 that provides retraction for the assembly to go from the open position to the closed position. The track spring 870 also allows for the electrode cover 840 to push towards the electrode cap 820 of the lamp 710 to make contact. Also, track spring 870 allows for the electrode cover 840 to stop at varying retracted positions to accommodate varying locations of the lamp's 710 electrode cap 820. This important aspect prevents the electrode cover 840 and/or spring contact 830 from applying too much pressure against the electrode cap 820 of the lamp 710.

Figure 9:
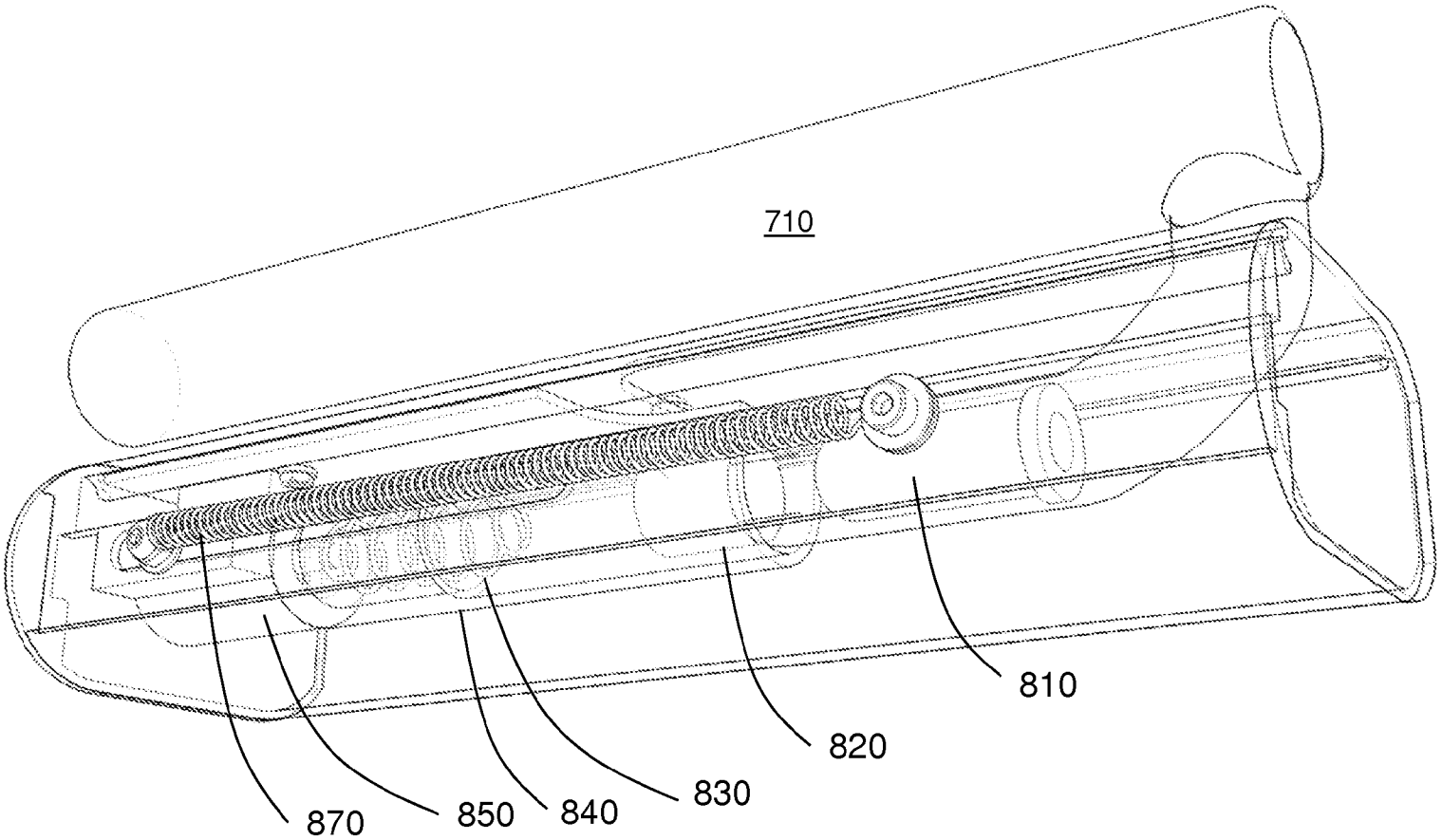
FIG. 9 is a partial perspective view of the flexible mini lighting system of FIG. 7 with the casing cover end segment open.

FIG. 9 shows the casing cover end segment 730 in the open position. The cold cathode lamp 710, with its lamp electrode 810 in a downward facing attitude can be inserted through the opening left by the retracted casing cover end segment 730. The lamp electrode and/or lamp electrode cap 820 will make contact with the retracted electrode cover 840, putting the cold cathode lamp 710 into proper alignment for the casing cover end segment 730, sliding electrode cover mount 850 assembly and electrode cover 840 to be returned to the closed position. The track spring 870 retracts, returning the casing cover end segment 730, sliding electrode cover mount 850 assembly and electrode cover 840 to the closed position.

Figure 10:
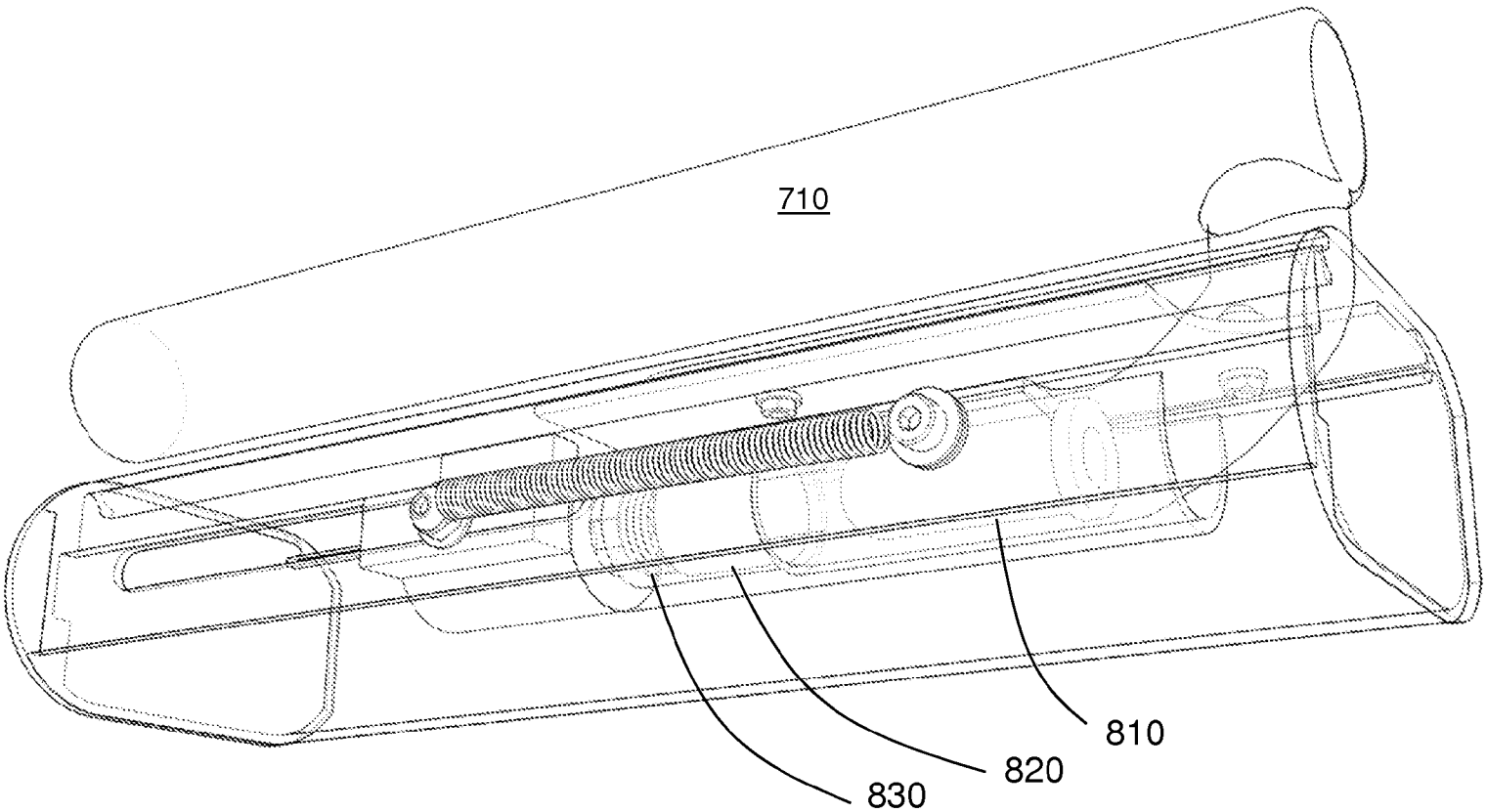
FIG. 10 is a partial perspective view of the flexible mini lighting system of FIG. 7 with the casing cover end segment closed.

FIG. 10 shows the casing cover end segment 730 in the closed position. When in this closed position, the spring contact 830 makes an electrical contact with the lamp electrode cap 820. After engaging both electrodes of the lamp 710 in the above manner, the electrical circuit is complete allowing the lamp to be energized.

Figure 11:
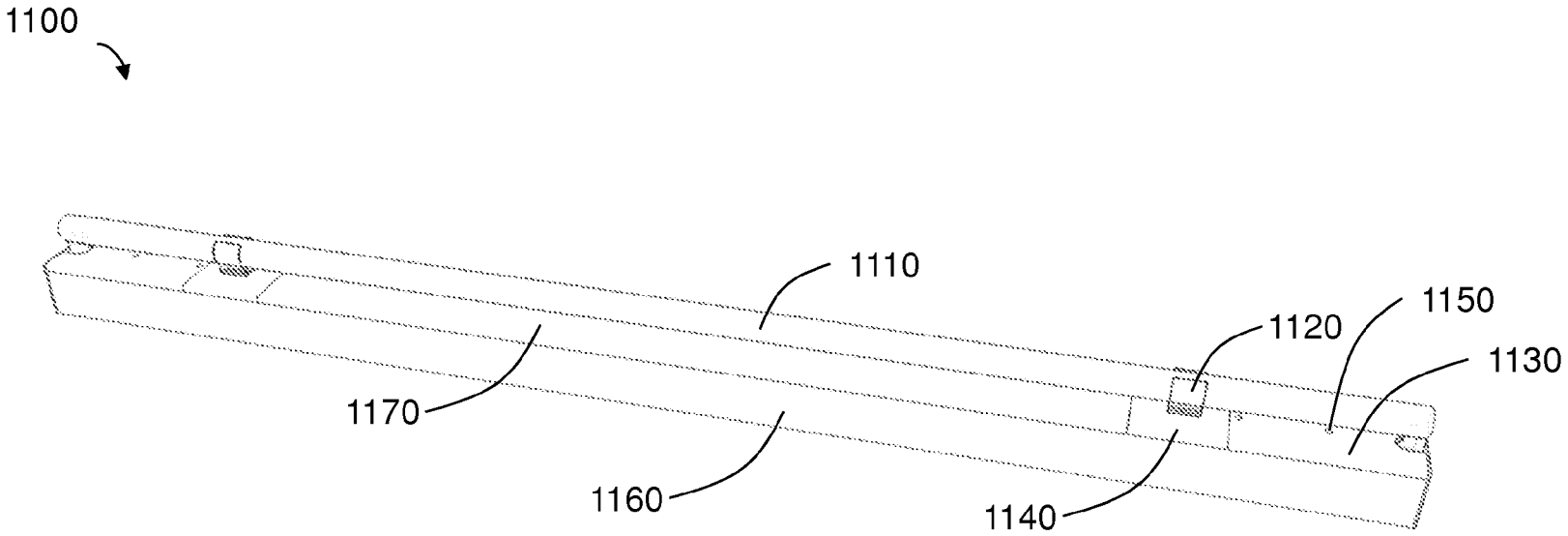
FIG. 11 is a perspective view showing another embodiment of a hybrid lighting system.
Figure 12:
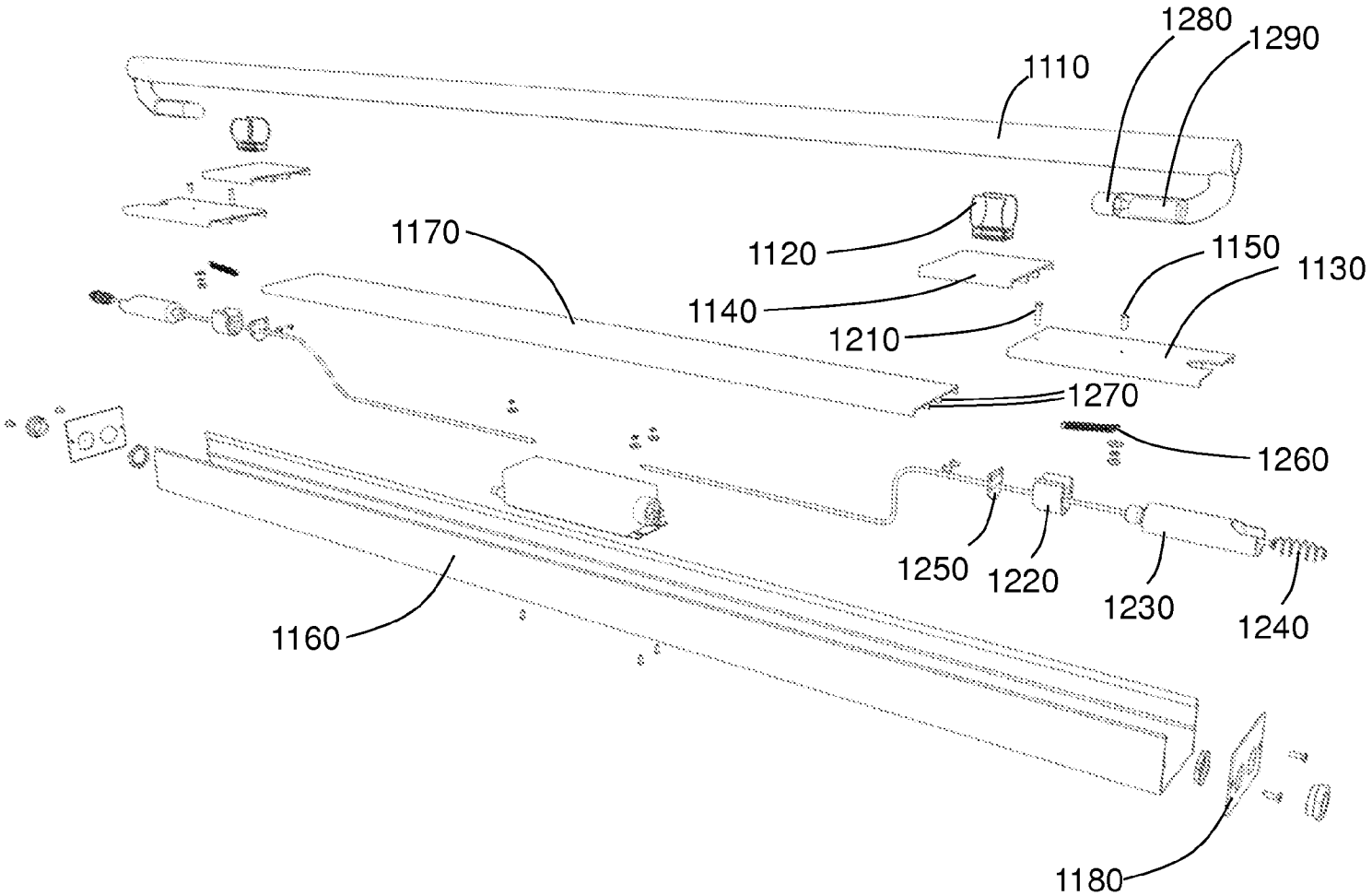
FIG. 12 is an exploded view of the hybrid lighting system of FIG. 11.

FIG. 11 shows another embodiment of a hybrid lighting system. These can be produced with relatively short boxes ore relatively long raceways of any length between approximately 3' to 8'. FIG. 12 shows an exploded view of this hybrid lighting system. As seen from FIG. 11 and FIG. 12, the top portion of the casing is comprised of the upper box 1170, detachable casing cover segment 1140, and casing cover end segment 1130. The casing cover end segments 1130 can be slid open and closed, and requires that the detachable casing cover segment 1140 be removed for it to be slid open. The casing cover end segment 1130 slides along the tracks at the upper edge of the sidewalls (also referred to as legs) of the bottom section 1160. These same legs, which act as tracks for the casing cover end segment 1130, also act as a protrusion for the detachable casing cover segment 1140 to be snapped on.

Figure 13A:
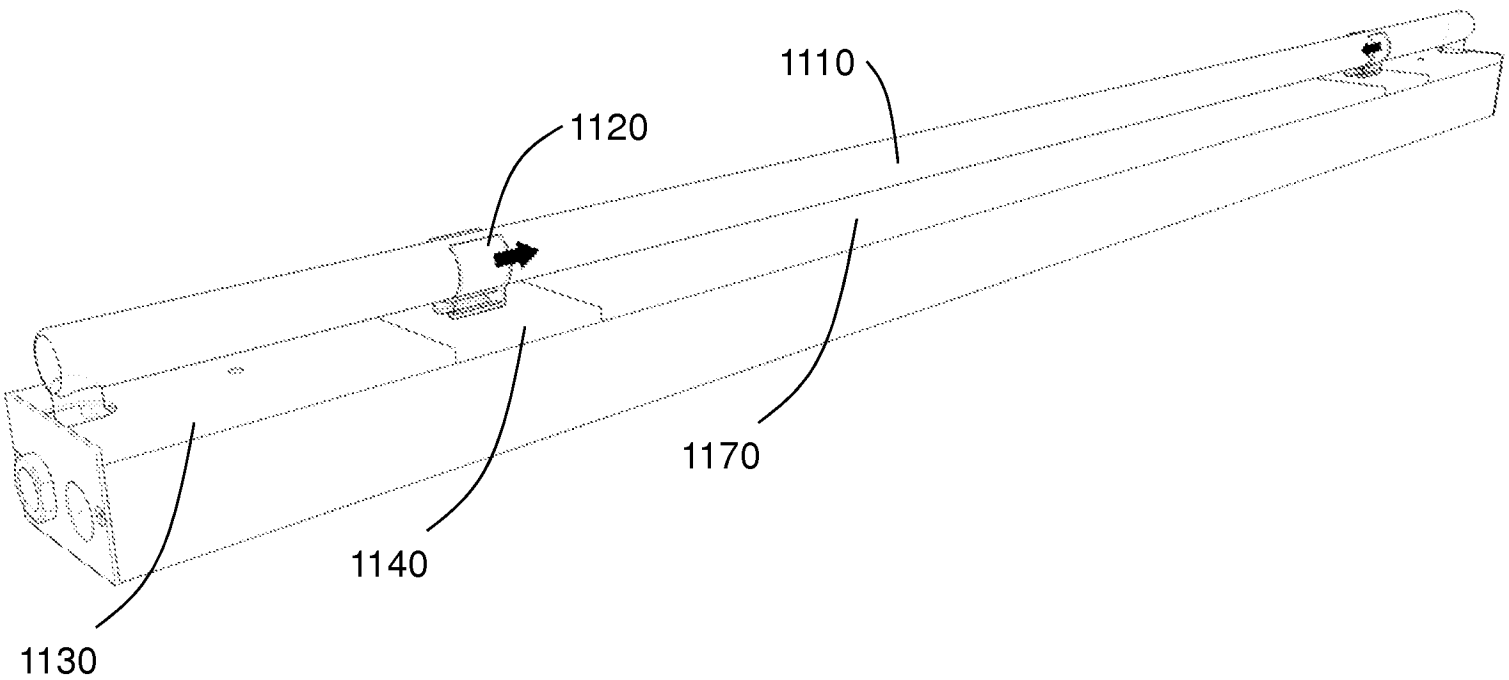
FIG. 13*a* is a perspective view of the hybrid lighting system of FIG. 11.
Figure 13B:
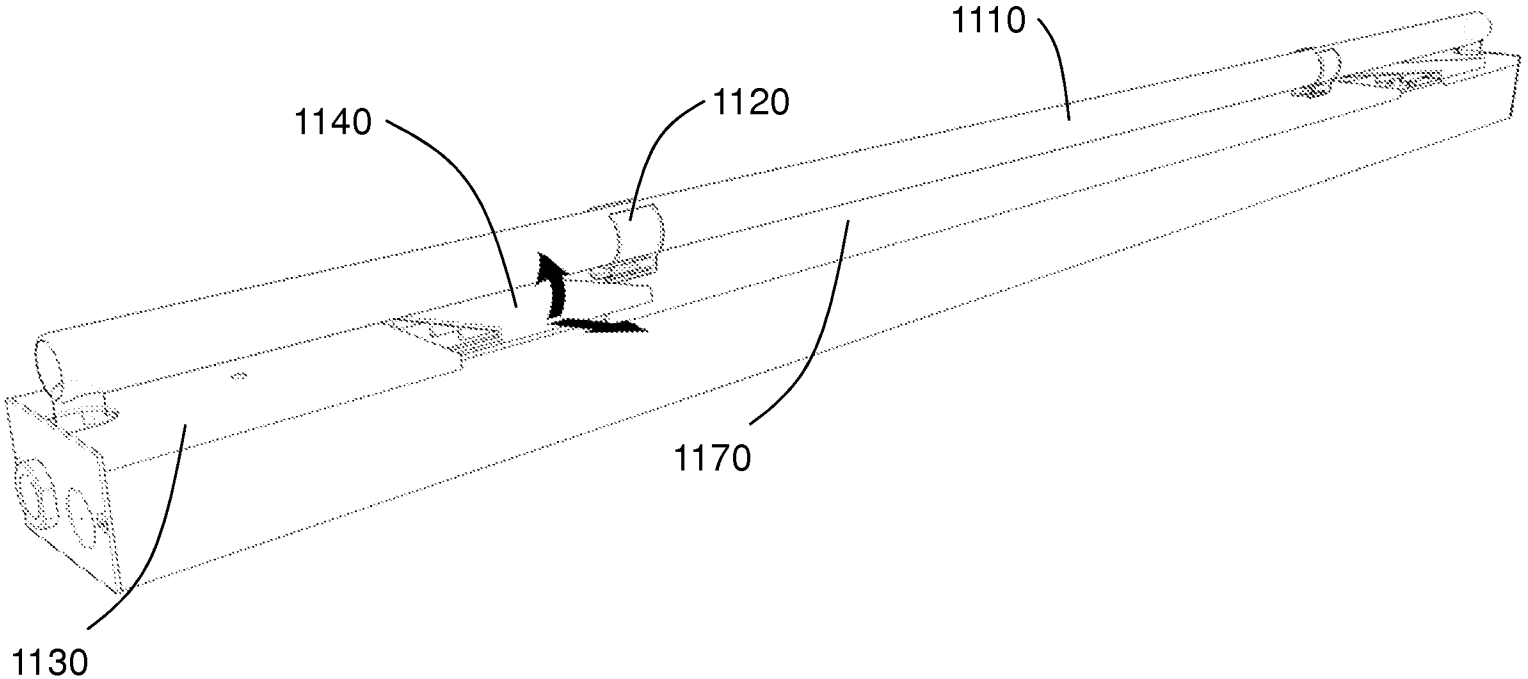
FIG. 13*b* is a perspective view of the hybrid lighting system of FIG. 11, where the detachable casing cover segment is being removed.
Figure 13C:
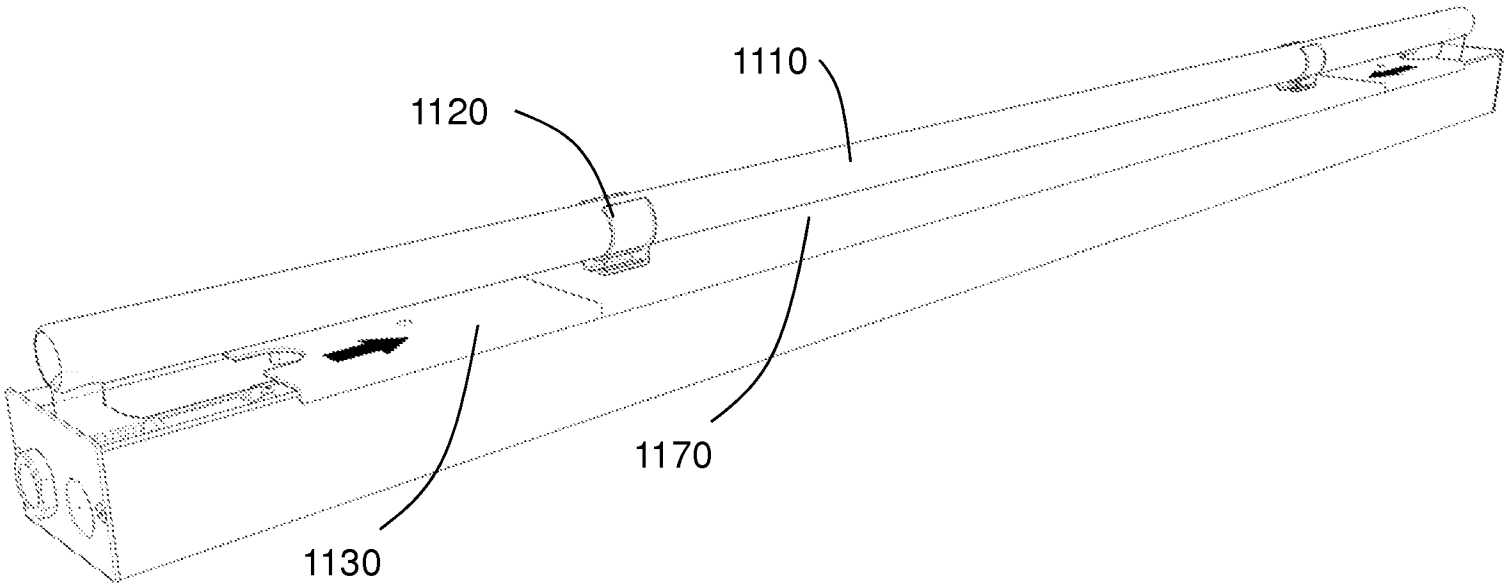
FIG. 13*c* is a perspective view of the hybrid lighting system of FIG. 11, where the casing cover end segment is slid open.
Figure 13D:
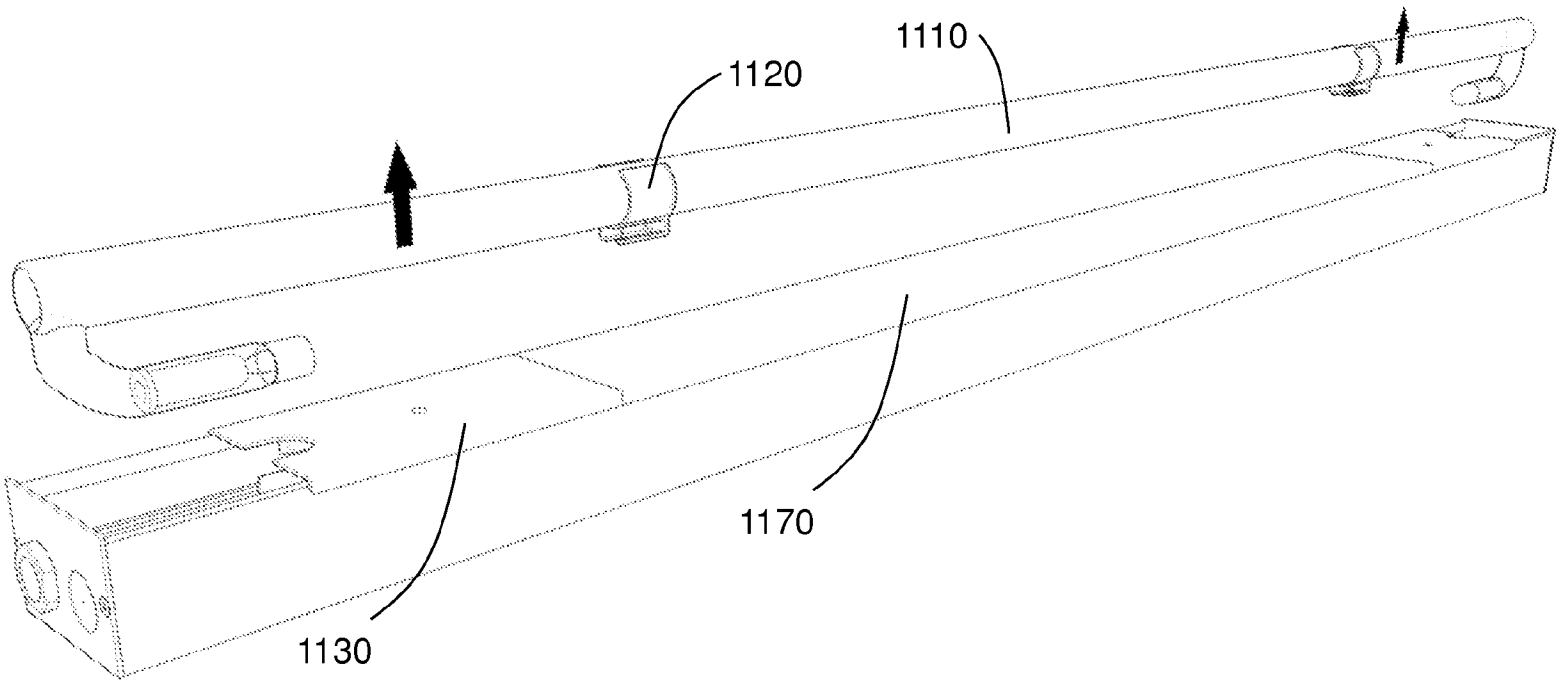
FIG. 13*d* is a perspective view of the hybrid lighting system of FIG. 11, where the cathode lamp is being removed.

FIGS. 13*a*, 13*b*, 13*c*, and 13*d* demonstrate the removal of the lamp 1110. In FIG. 13*a*, the lamp clip 1120 is moved away from the detachable casing cover segment 1140. In FIG. 13*b*, the detachable casing cover segment 1140 is removed. In FIG. 13*c*, the casing cover end segment 1130 may be slid inward and into the open position. In FIG. 13*d*, the lamp 1110 is removed with the casing cover end segment 1130 in the open position.

Referring back to the exploded view in FIG. 12, it is shown that the electrode cover assembly is comprised of the electrode cover 1230, spring contact 1240, U chamber 1220, and U chamber end plate 1250. The U chamber 1220 and U chamber end plate 1250 are considered electrode cover adapters. The U chamber 1220 has its two end points facing in the upward direction, and fit into the track underneath the casing cover end segment 1130. There are two tracks under the casing cover end segment 1130 that are both "L" shaped and facing towards one another. The U chamber 1220 slides along these tracks. The U chamber's 1220 two end points have a groove shaped profile as a means to fit and slide along these tracks. Note, FIG. 12 also shows similar tracks 1270 under the upper box (or casing cover) 1170, which does not necessarily have to be there, but are there to simplify the manufacturing process. There is a spring 1260 that is attached via a screw to the casing cover end segment at one end, and fixedly attached to the U chamber 1220 at the other end.

Figure 14:
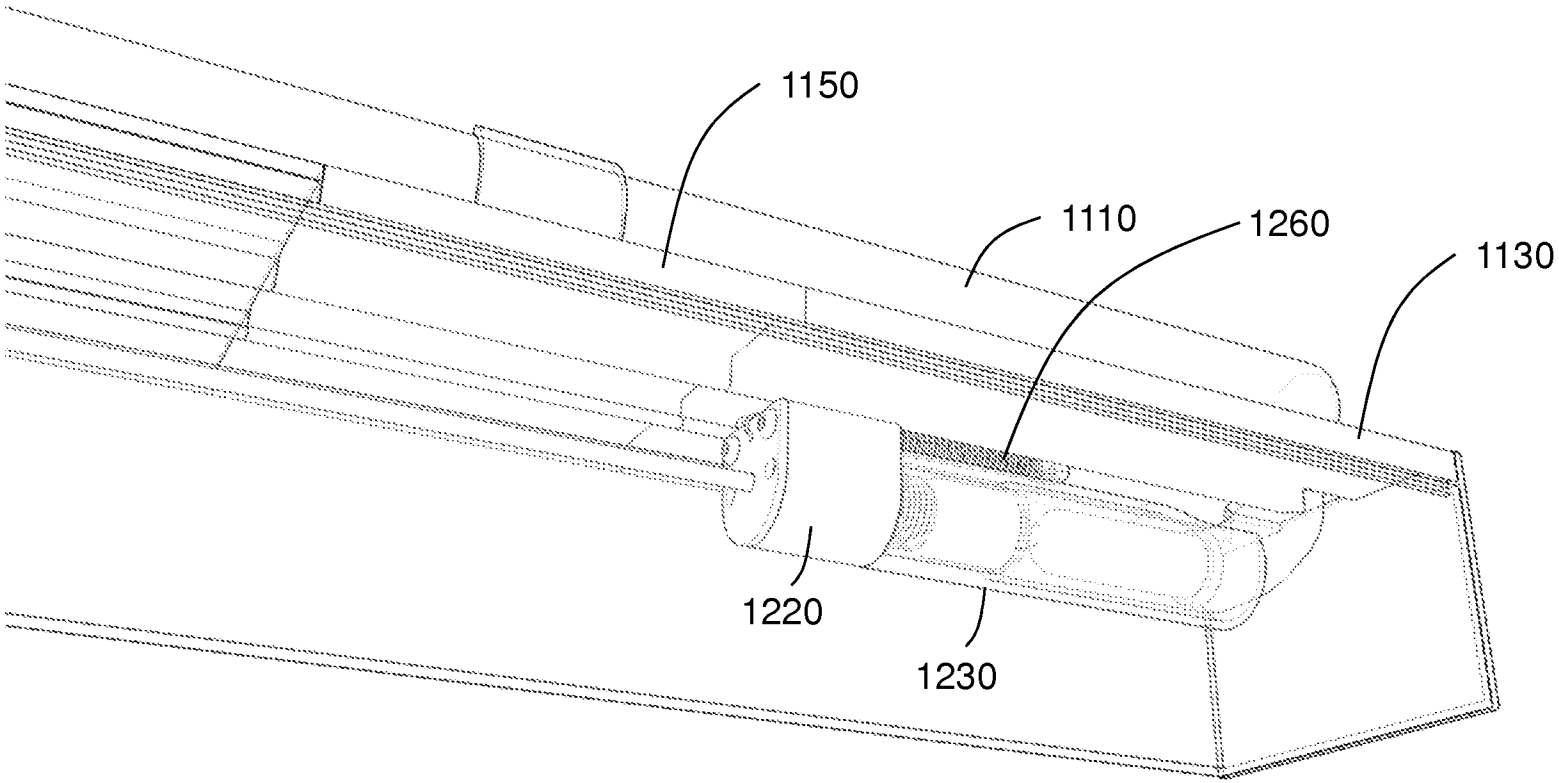
FIG. 14 is a perspective view of the hybrid lighting system of FIG. 11.
Figure 15:
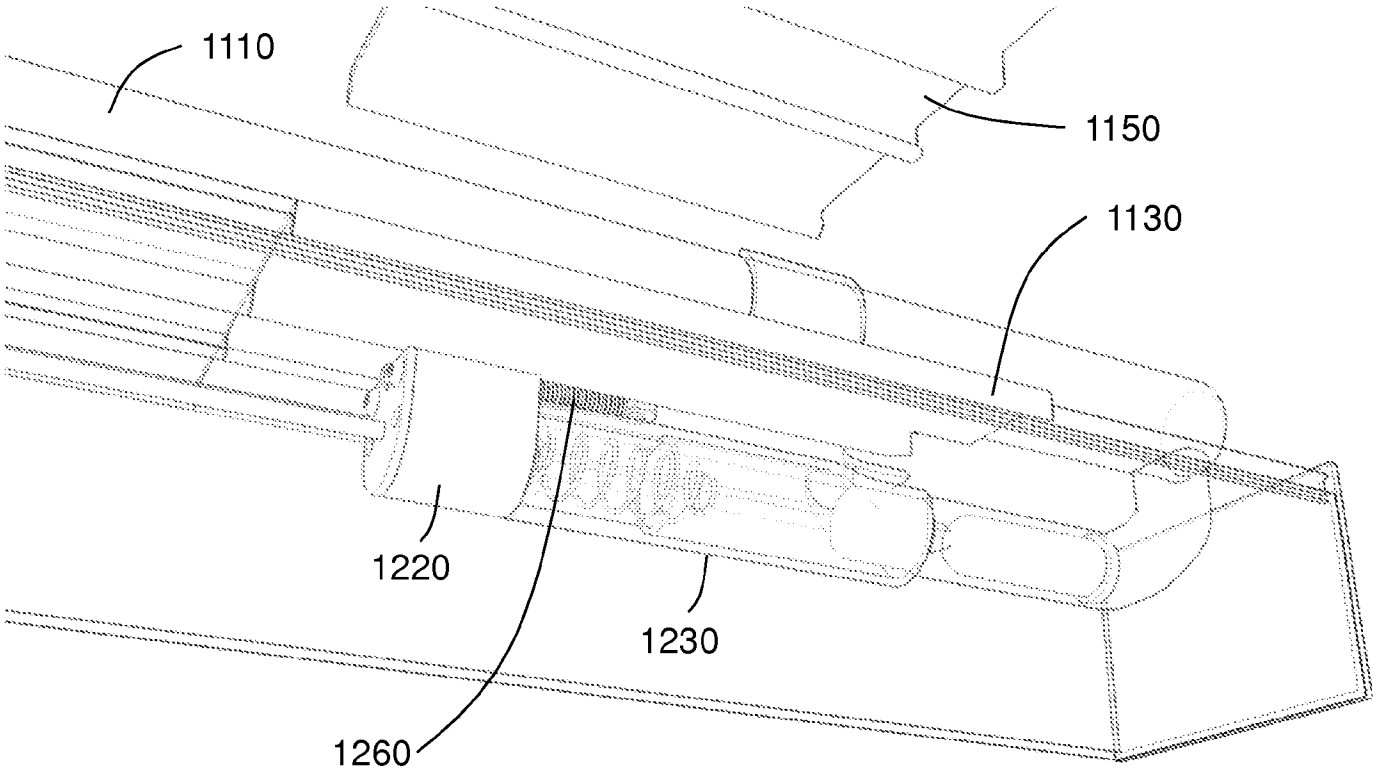
FIG. 15 is a perspective view of the hybrid lighting system of FIG. 11, where the detachable casing cover segment is removed and the casing cover end segment is slid open.

FIG. 14 shows a bottom perspective view of the lighting system of this embodiment. Here, the casing cover end segment 1130 is closed, and the detachable casing cover segment 1150 is attached. FIG. 15 shows the same bottom perspective view, but with the detachable casing cover segment 1150 detached and the casing cover end segment 1130 in the open position. As shown, opening the casing cover end segment 1130 causes the electrode cover 1230 to slide inward since the electrode cover 1230 is indirectly connected to the casing cover end segment 1130 through the spring 1260. The main purpose of the spring 1260 is for when the lamp 1110 is inserted and the casing cover end segment 1130 is in the closed position. The spring 1260 allows for the electrode cover 1230 to stop at varying retracted positions to accommodate varying locations of the lamp's 1110 electrode cap 1280. This compensates for varying lengths of the lamp electrode 1290 and electrode cap 1280 with generally greater tolerance than many commercial products. This important aspect prevents the electrode cover 1230 and/or spring contact 1240 from applying too much pressure against the electrode cap 1280 of the lamp 1110. This in turn eliminates the transmission force that could damage, crack, or break the electrode and lamp.

There is a post 1210 attached to the underside of the casing cover end segment 1130 and is centered between the opposing "L" shaped tracks of the casing cover end segment 1130. This post 1210 acts as a stop to prevent the U chamber 1220 from sliding out of the track and becoming disengaged.

In FIG. 15, it can be seen how a cathode lamp 1110 is inserted into this lighting system. While the casing cover end segment 1130 is in the open position, and the electrode cover 1230 is retracted, the lamp 1110 may be inserted by having its electrode portion inserted into the opening exposed by the casing cover end segment 1130. The lamp's 1110 electrode will make contact with the retracted electrode cover 1230, putting the cathode lamp into proper alignment for the electrode cover 1230, U chamber 1220, and casing cover end segment 1130 to be returned to the closed position. The spring 1260 gently pulls the U chamber 1220 and electrode cover 1230 causing it to slide along the track and keep it in constant contact with the lamp electrode. In this closed position the spring contact 1240 makes an electrical contact with the lamp electrode cap 1280. With both of the casing cover end segments 1130 closed, the detachable casing cover segments 1140 may be snapped back into the lower box 1160. After engaging both electrodes of the lamp 1110 in the above manner, the electrical circuit is complete allowing the lamp to be energized.

Figure 16:
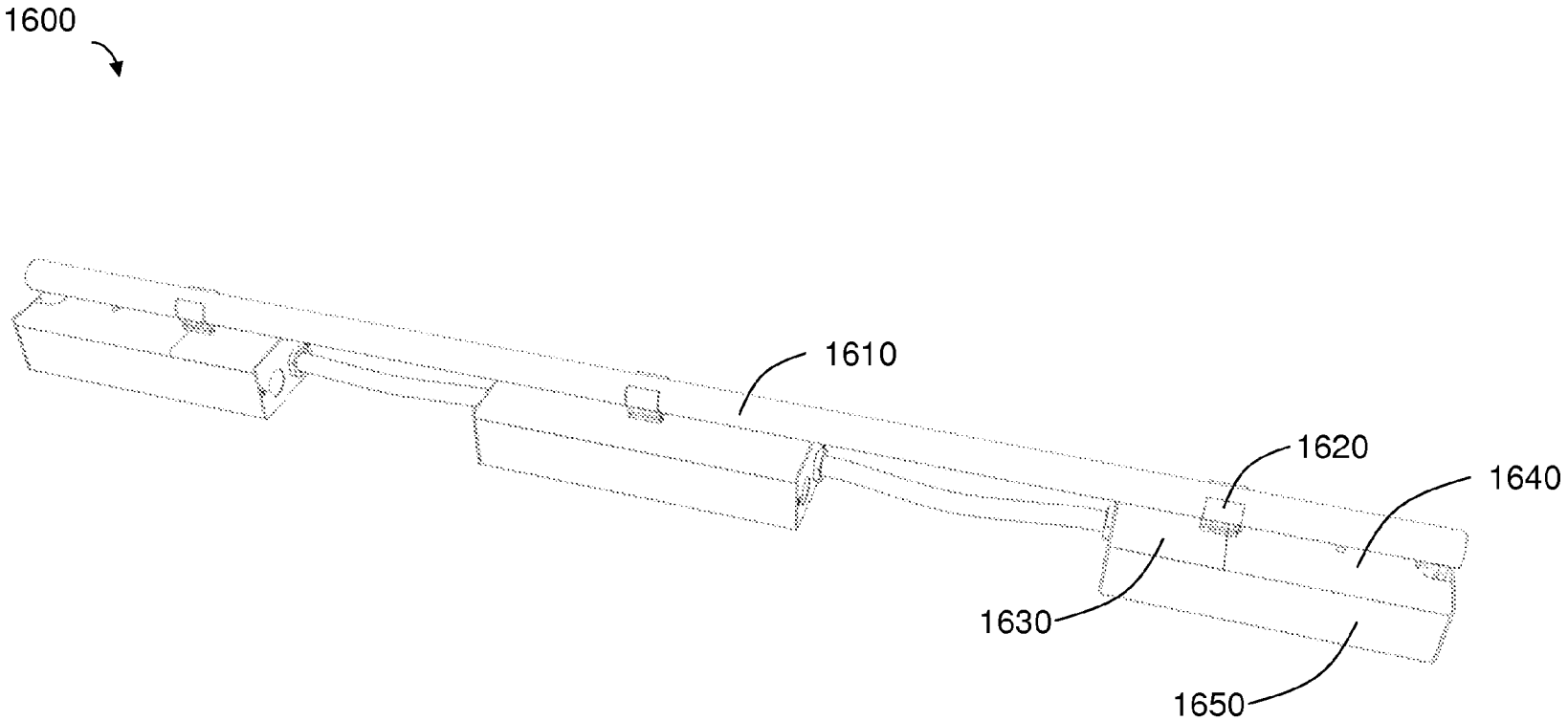
FIG. 16 is another embodiment of a hybrid flexible lighting system.
Figure 17:
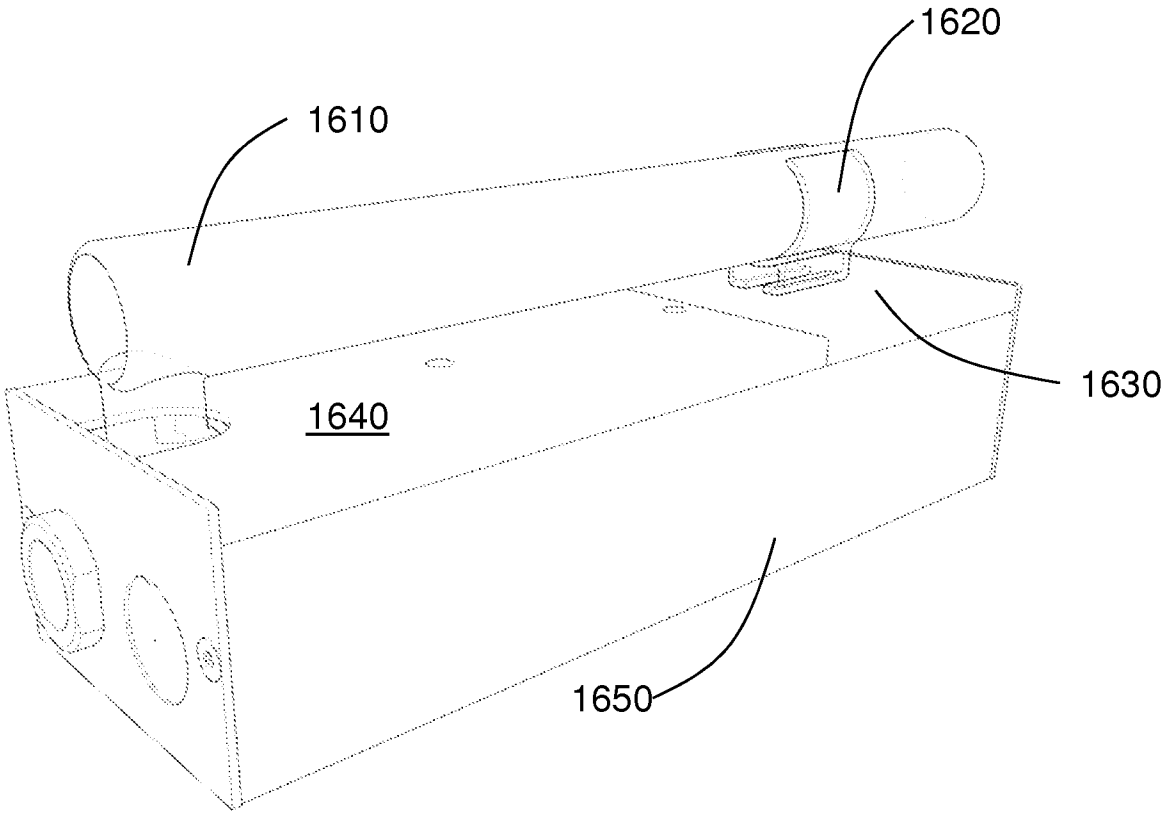
FIG. 17 is a partial view of the hybrid flexible lighting system of FIG. 16.
Figure 18:
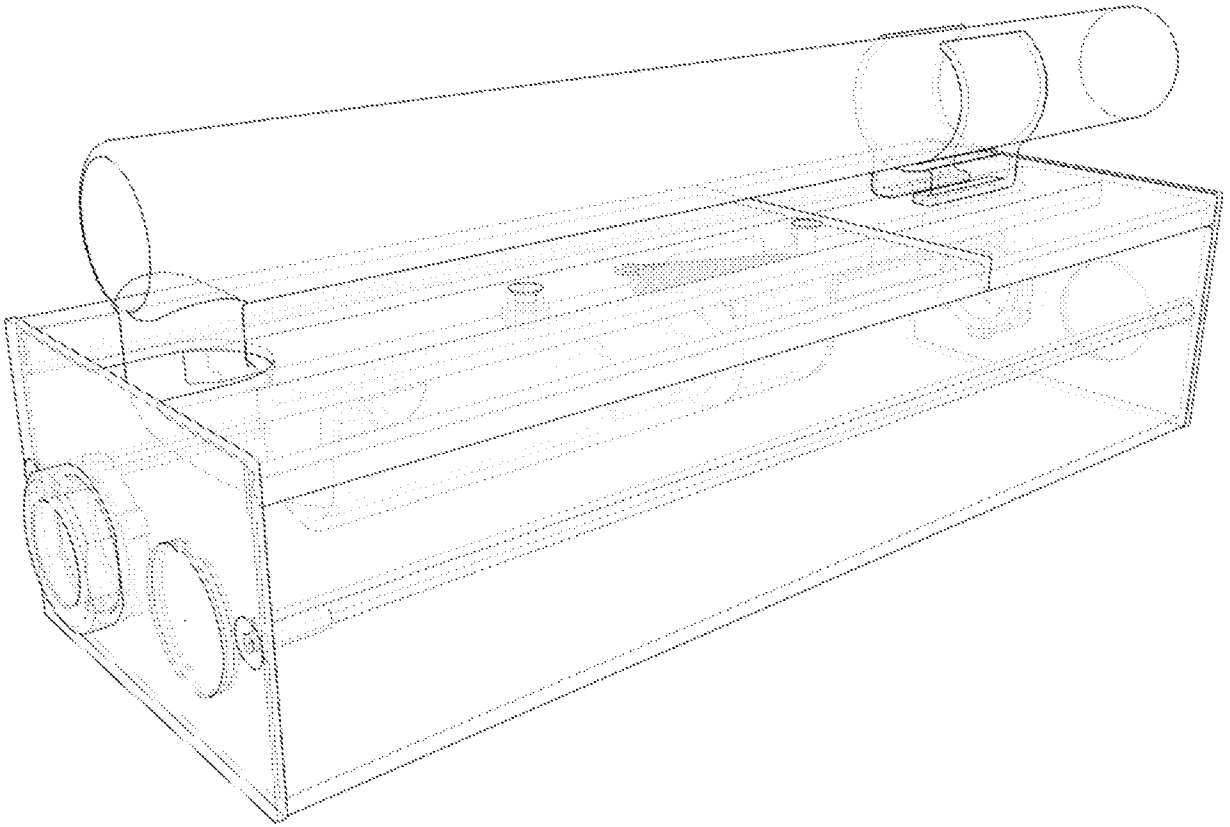
FIG. 18 is a partial, transparent view of the hybrid flexible lighting system of FIG. 16.

FIG. 16 shows another embodiment of a hybrid flexible lighting system. FIG. 17 is a partial view of the hybrid flexible lighting system of FIG. 16. It operates similarly to the lighting system of FIG. 11. The lamp clip 1620 can be moved to allow the detachable casing cover segment 1630 to be snapped off from the lower box 1650. The casing cover end segment 1640 can be slid open, which interacts with an electrode cover assembly very much like that of FIG. 11. The apparent difference here is that the casing is sectionalized, and can be comprised of a plurality of casings. The center casing contains the power supply. The casings may be arranged to allow for other than a straight-line lamp to accommodate the specific requirements for architectural conditions in which they are being used. Hybrid flexible electrical conduit and trade fittings may be used to electrically connect these casings through provided knockouts. All casing are furnished with removable upper covers, making all the internal elements within said casing fully accessible for easy installation, electrical connection and servicing by the electrical trade or other qualified to install lighting products. It is shown here that the outer end casings can have the same electrode cover assembly functionality of FIG. 11 can be applied here.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

What is claimed is:

1. A cold cathode lighting system comprising:

a cold cathode lamp with electrodes on either end of the lamp, oriented such that there are bend backs to return the electrode to the same parallel position as the main body of said cold cathode lamp;

a casing comprising of a casing cover end segment;

an electrode cover assembly;

a means for sliding said electrode cover assembly in a first direction to allow insertion of said electrodes from said cold cathode lamp's electrode; and a means for sliding said electrode cover assembly in a second direction to place said electrode cover in contact with said cold cathode lamp's electrode.

2. The cold cathode lighting system of claim 1, further comprising a spring acting on said electrode cover assembly, permitting the movement of said electrode cover assembly to stop, due to contact with said lamp's electrode.

3. The cold cathode lighting system of claim 1, further comprising of an electrode cover adapter that is attached to said electrode cover assembly, wherein said electrode cover adapter is held by and slides on a track.

4. The cold cathode lighting system of claim 3, wherein said electrode cover adapter being held by said track is held loosely, whereby said electrode cover assembly may have some wiggle room to accommodate various angles of said cold cathode lamp's electrode.

5. The cold cathode lighting system of claim 3, wherein said track is under said casing cover end segment.

6. The cold cathode lighting system of claim 1, wherein said casing further comprises of a detachable casing cover segment adjacent to said casing cover end segment.

7. The cold cathode lighting system of claim 1, wherein said cold cathode lamp's electrode is comprised of an electrode cap.

8. The cold cathode lighting system of claim 2, wherein said spring is affixed on one end to said casing cover end segment and affixed on the other end to said electrode cover assembly.

9. A cold cathode lighting system comprising:

a cold cathode lamp with a main body and with first electrode and second electrode, on either ends of the lamp, oriented such that there are bend backs to return said electrodes to the same parallel position as said main body;

a casing comprising a first casing cover end segment and second casing cover end segment, on either ends of said casing, wherein said casing cover end segments are capable of sliding open to accommodate the insertion of said electrodes of said cold cathode lamp; and a first electrode cover assembly and second electrode cover assembly inside said casing, wherein said first electrode cover assembly slides inward within said casing when said first casing cover end segment is slid open and said second electrode cover assembly slides inward within said casing when said second casing cover end segment is slid open.

10. The cold cathode lighting system of claim 9 further comprising a first spring acting on said first electrode cover assembly and a second spring acting on said second electrode cover assembly, permitting the movement of said electrode cover assemblies to accommodate common variations in length and angle of said lamp's electrode portions.

11. The cold cathode lighting system of claim 9, further comprising a first electrode cover adapter and second electrode cover adapter attached to first electrode cover assembly and second electrode cover assembly respectively, wherein said electrode cover adapters are held by and slide on a track.

12. The cold cathode lighting system of claim 11, wherein said electrode cover adapters are loosely held on said track, whereby said electrode cover assemblies have some wiggle room to accommodate various angles of said electrodes.

13. The cold cathode lighting system of claim 11, wherein said track is under said casing cover end segments.

14. The cold cathode lighting system of claim 9, wherein said casing further comprises of a first detachable casing cover segment adjacent to first casing cover end segment and a second detachable casing segment adjacent to second casing cover end segment.

15. The cold cathode lighting system of claim 10, wherein said first spring is affixed on one end to said first casting cover end segment and affixed on the other end to said first electrode cover assembly, and said second spring is affixed on one end to said second casing cover end segment and affixed on the other end to said second electrode cover assembly.

* * * * *